US009963833B2

(12) United States Patent
Andre

(10) Patent No.: US 9,963,833 B2
(45) Date of Patent: May 8, 2018

(54) RAIL CROSSING DESIGNED FOR CROSSING A GUIDE RAIL WITH A SECOND RAIL

(71) Applicant: NewTL, Ernolsheim sur Bruche (FR)

(72) Inventor: Jean-Luc Andre, Molsheim (FR)

(73) Assignee: NewTL, Ernolsheim sur Bruche (FR)

( * ) Notice: Subject to any disclaimer, the term of this patent is extended or adjusted under 35 U.S.C. 154(b) by 244 days.

(21) Appl. No.: 14/785,206

(22) PCT Filed: Jun. 10, 2014

(86) PCT No.: PCT/FR2014/051384
§ 371 (c)(1),
(2) Date: Oct. 16, 2015

(87) PCT Pub. No.: WO2014/207339
PCT Pub. Date: Dec. 31, 2014

(65) Prior Publication Data

US 2016/0083912 A1 Mar. 24, 2016

(30) Foreign Application Priority Data

Jun. 25, 2013 (FR) ..... 13 56092

(51) Int. Cl.
*E01B 7/28* (2006.01)
*E01B 25/28* (2006.01)

(52) U.S. Cl.
CPC ..... *E01B 7/28* (2013.01); *E01B 25/28* (2013.01)

(58) Field of Classification Search
CPC ..... E01B 7/00; E01B 7/02; E01B 7/18; E01B 7/28; E01B 7/30
See application file for complete search history.

(56) References Cited

U.S. PATENT DOCUMENTS 909,189 A * 1/1909 Kaltschmidt ..... E01B 7/00 246/375
1,244,439 A * 10/1917 Forester ..... E01B 7/00 246/375

(Continued)

FOREIGN PATENT DOCUMENTS

DE 19929773 A1 1/2001
EP 2500468 A1 9/2012

(Continued)

OTHER PUBLICATIONS

International Search Report issued in PCT/FR2014/051384 dated Sep. 22, 2014.

*Primary Examiner* — Robert J McCarry, Jr.
(74) *Attorney, Agent, or Firm* — Marshall, Gerstein & Borun LLP

(57) ABSTRACT

The invention concerns a rail crossing device designed for crossing a first rail embedded in a road surface with a guide rail, embedded in the road surface. It comprises at least one extensible portion provided in the guide rail and at least one mechanism designed for lengthwise extension and contraction of the extensible portion. This mechanism is designed to extend and contract the extensible portion in a lengthwise direction, defining a contracted position in which one end of the guide rail is separated from the first rail to allow a vehicle or any other movable device to travel along this rail, and an extended position in which said end of the guide rail is moved towards the first rail in order to guide a vehicle onto the guide rail.

20 Claims, 7 Drawing Sheets

(56) References Cited

U.S. PATENT DOCUMENTS 1,399,289 A * 12/1921 Brady ..... E01B 7/00
246/273
1,655,521 A * 1/1928 Spahr, Sr. ..... E01B 7/30
246/375

FOREIGN PATENT DOCUMENTS

GB 642700 A 9/1950
WO WO-2010/018310 A1 2/2010

* cited by examiner

RAIL CROSSING DESIGNED FOR CROSSING A GUIDE RAIL WITH A SECOND RAIL

CROSS-REFERENCE TO RELATED APPLICATIONS

This application is a national stage application under 35 U.S.C. § 371 and claims the benefit of priority of international application no. PCT/FR2014/051384, filed Jun. 10, 2014, which claims the benefit of priority under 35 U.S.C. § 119 of French patent application no. 1356092, filed Jun. 25, 2013, and the entire contents of each is hereby incorporated herein by reference, in its entirety and for all purposes.

TECHNOLOGICAL FIELD

This patent concerns a crossing device intended for the crossing of a first rail, for instance a railway rail with a guide rail.

BACKGROUND

In large cities, the current trend is a change towards increasing use of urban public transport networks such as trams running on tires. Among the vehicles running on tires currently used, some are guided by a central rail embedded into the road surface. This guide rail sometimes crosses another rail in which case a crossing system is necessary.

In conventional railway crossings, that is, designed for the crossing of two railway tracks, the rails are interrupted at the crossing, with sufficient spacing to allow passage of the central protruding part of railway wheels, known as the flange or rim. Generally, the space is a few centimeters. It can be seen in FIG. 1 which illustrates a prior embodiment.

If one of the crossing rails is a guide rail, it is not always considered tolerable to interrupt this rail over any considerable length, essentially for reasons of reliable guidance. Indeed, especially for the guidance of road-going vehicles by a central rail, for the homologation of traffic on the public roads, the rail must not contain any gaps more than a few millimeters long.

Accordingly, conventional railway crossings are unsuitable for the crossing of a guide rail with another rail whether it is a guide rail, a conventional railway rail or any other type of rail. Therefore, there is a requirement for a specific crossing device designed for the crossing of a first rail with a guide rail.

In addition, because guidance of public transport vehicles running on tires by a central rail is generally used in the urban environment, the guide rails and the other rails are all embedded into the road surface having their top surface flush with the road surface to allow the passage of other road going vehicles, especially cars, on the road surface. This recessing of the rails into the road surface means that the desired specific crossing device must not only fulfil this requirement but it must also be itself recessed into the road surface and not impede vehicular traffic.

BRIEF DESCRIPTION OF THE DRAWINGS

Characteristics and advantages of the described embodiments will appear from the reading of the detailed description which follows, referring to the attached illustrations given as non-limitative examples and in which.

SUMMARY

Figure 1:
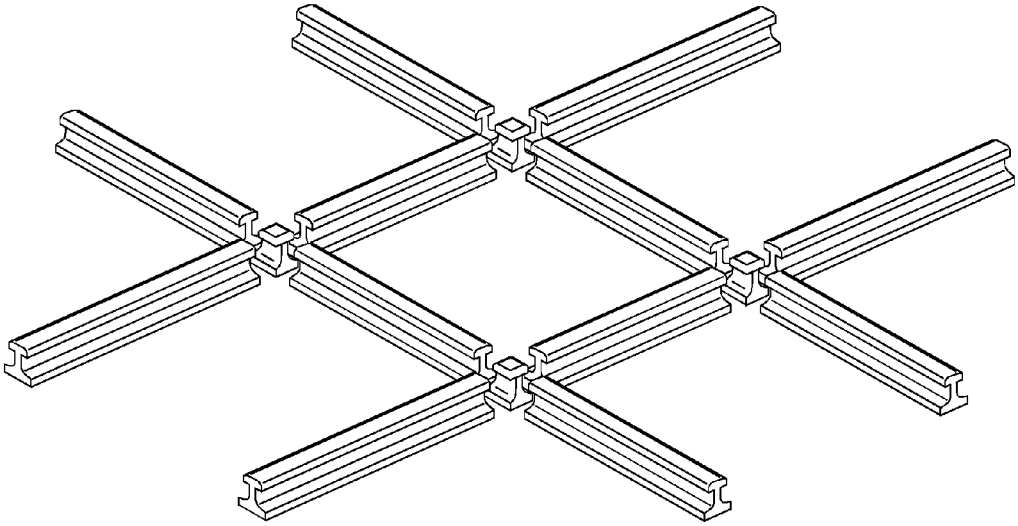
FIG. 1 PRIOR ART
FIG. 1 is a schematic perspective view of a conventional railway crossing illustrating the prior art.

Advantageously, a device of this type must be reliable, rugged and suitable for manual operation in case of failure, because it is designed for use on city streets where any disturbance of the traffic has to be avoided.

In the same way, when it is used in the urban environment, a crossing device like this must not represent a danger to pedestrians, especially when it is being operated.

The device must also be compact and take up the smallest possible area of the road surface, because of the often high density of the other equipment already present on the city streets.

A purpose of the presently described embodiments is to supply a new rail crossing device which does not affect the guide function attributed to at least one of the rails.

Another purpose of the presently described embodiments is to supply a crossing device designed for the crossing of a guide rail with a second rail and which fulfils the other criteria mentioned above.

The goals assigned to the presently described embodiments are achieved by means of a rail crossing device designed for the crossing of a first rail system embedded into the road surface with a second rail system embedded into the road surface, which device including:

a first rail system designed for the movement or guidance of a vehicle or any other moveable device, and including:

at least one first rail having a rail head whose upper surface is approximately flush with the road surface, a first lateral face and a second lateral face opposite the first; and at least one spacing device designed to establish a passage space for the relief structures of the running or guidance means (a guide) at the least on one side of the first lateral face of the rail head;

a second rail system designed for the guidance of a vehicle and including at least one guide rail, which guide rail:

has a rail head with an upper face approximately flush with the road surface and crossing the first rail;

is interrupted at the crossing with the first rail to form two portions, having respectively a first end and a second end extending the first end;

at least one extensible part integrated into at least the first or the second portion;

at least one manoeuvring mechanism designed for lengthwise extension and contraction of the extensible part, defining a contracted position in which the first end is moved away from the first rail to allow the passage of a vehicle or any other mobile device over the first rail; and an extended position in which the first end is moved closer to the first rail to guide a vehicle along the guide rail.

According to one embodiment, the first portion is placed on the side of the first lateral face of the first rail and has a first end located on the side of the first lateral face of the first rail, while the second portion is located on the side of the second lateral face of the first rail and has a second end located immediately next to the second lateral face of the first rail and forming an extension to the first end. According to this embodiment, when the extensible part is in the contracted position, the first end is moved away from the first lateral face of the first rail whereas, when the extensible part is in the extended position, the first end is moved closer to the first lateral face of the first rail.

According to another embodiment, the rail crossing device includes a path guiding means for the extensible part of the guide rail, in order to guide it in the lengthwise extension and contraction of the extensible part on a defined path.

According to another embodiment, the spacing device consists of a groove provided in the rail head on the side of the first lateral face of the first rail, which groove may be edged laterally by a flange, while at the crossing, the flat strip includes a cut-out which allows the first end of the guide rail to slide over the spacing device of the first rail during the extension of the extensible part.

According to another embodiment, the spacing device consists of a free volume provided between the first lateral face of the rail head and the road surface.

According to other embodiments, the extensible part of the guide rail consists of alternating machining into the rail or an assembly of transversal leaves.

Similarly, according to another embodiment, the extensible part of the guide rail consists of an assembly of transversal leaves connected together by telescopic nesting by sliding over at least one shared longitudinal guide structure.

According to another embodiment, the extensible part of the guide rail consists of a stack of flexible leaves, welded in alternation at the top and bottom like an accordion.

Finally, an elastic material is interposed between each transverse leaf.

According to an additional embodiment, for the extensible part, the contracted position corresponds to a balanced position at mid-travel point with respect to the manoeuvring mechanism.

According to another embodiment, at the crossing, the first rail is continuous and in one piece. It has cut-outs in its rail head to clear a passage for the guide means of the rail-guided vehicle which cut-outs can be transversal and be made in parallel to the axis of the two portions of the guide rail.

According to another embodiment, at the crossing, the first end of the guide rail has a hollow under the upper face of the rail head enabling it to slide over the spacing device of the first rail when the extensible portion is extended.

In addition, according to another embodiment, the vehicle or another moveable device designed to travel over the first rail system has wheels designed to run on at least one first rail with these wheels bearing solely on this first rail.

Finally, in other embodiment examples, the manoeuvring mechanism includes at least one hydraulic, pneumatic or electric actuator, or at least one worm screw. It can also include at least one manual emergency manoeuvring device for operating the manoeuvring mechanism by hand in the event of failure.

DETAILED DESCRIPTION

The presently described crossing devices offer many advantages. The extensible design of the guide rail is a way of maintaining satisfactory continuity of this rail at the crossing point, while allowing it to be backed off from the rail it crosses to allow a vehicle to move over the latter.

Generally speaking, the crossing devices described herein aim at fulfilling the following conditions:

1) The weight of the vehicle designed to travel over the first rail system must not rest on any moving part of the device, so as to minimise any risks of its deterioration when said vehicle moves over it.

2) When a vehicle moves over the first rail system, the second rail system is not deviated laterally as in the case of conventional switches; it is simply retracted and stays on the same line while its moving parts do not obstruct any grooves in the first rail system. Accordingly, when the guided vehicle moves over a mobile portion of the device, in the event of a mobile part of the device being incorrectly positioned, it will not necessarily cause the derailing of the said rail-guided vehicle, especially if the extensible portion of the second rail system is straight. In reality, the actuation of the device with the retraction of the extensible portion creates only a gap in the guide rail but not its deviation or interruption.

3) The presently described crossing devices have to be embedded into the road surface obviously requiring a number of technical points that the presently described crossing device fulfils.

The crossing device of the presently described embodiments is particularly compact. The moving away of the guide rail from the first rail is by the translation of an extensible portion, not requiring any additional space in the road surface, unlike a swiveling or turntable system, for instance. Similarly, the guide system of the extensible portion has negligible dimensions with respect to the road surface, while the manoeuvring means designed for the lengthwise extending and contracting of the extensible portion can consist of a compact lengthwise mechanism preferably housed under the rail so to take up a minimal volume of the road surface.

Another advantage of the presently described embodiments is the possibility of actuating the device either at a distance, and preferably by an automated system, or manually on the spot.

In addition, because it does not contain any particularly fragile or delicate parts and has few moving parts, the presently described embodiments are particularly robust, barely prone to failure, and do not require regular maintenance. A manual emergency manoeuvring device and a greasing device for the manoeuvring means again reinforce the reliable and lasting nature of the presently described embodiments.

When the device concerned by the presently described embodiments is operated, only the extensible portion moves with respect to the road surface. In addition, the movement is of a small amplitude and is hardly liable to injure a passer-by, especially when the extensible portion does not contain any gaps in which a passer-by could be caught, particularly advantageous from the point of view of safety in the urban environment.

When the first rail system at a crossing contains a supporting groove taking up the running weight of the vehicle and not having any discontinuities, the wheels of this vehicle do not bear on the rail head containing cut-outs, or more especially on the extensible part of the second rail system. Thus, the presence of the crossing according to the presently described embodiments does not generate any additional noise when the vehicle moves over the first rail system.

Finally, if it considered desirable to adapt the device of the presently described embodiments to an existing first rail system, the device can be adapted without any need to replace all or part of the existing rails. In reality, it would be simply necessary to make transverse cuts into their heads, for instance using a grinding tool, and if necessary to fill in partially and locally the groove of the existing rail or rails, for instance by casting a suitable material into it, without needing any other modification to them.

The crossing device 1 is designed for the crossing of a first rail system 2 with a second rail system 3, said rail systems 2, 3 embedded into a running road surface 4.

The first rail system 2 may be designed for the circulation or guidance of a vehicle or of any other movable device, for instance a sliding structure mounted on a rail, a means of handling running on rails, an overhead travelling crane, a gantry, etc.

This first rail system 2 includes a first rail 5 having rail head 6, generally designated as being mushroom-shaped. It can be a guide rail, a conventional railway rail, or any other type of rail. The first rail 5 may have no groove or may have one or two grooves.

The first rail system 2 is embedded into a traffic-bearing road surface 4 with the upper face 7 of the head 6 of the first rail 5 more or less flush with the road surface 4 in order not to impede circulation, especially vehicular.

This first rail 5 also has a first lateral face 8 and a second lateral face 9 opposing the first.

Figure 2:
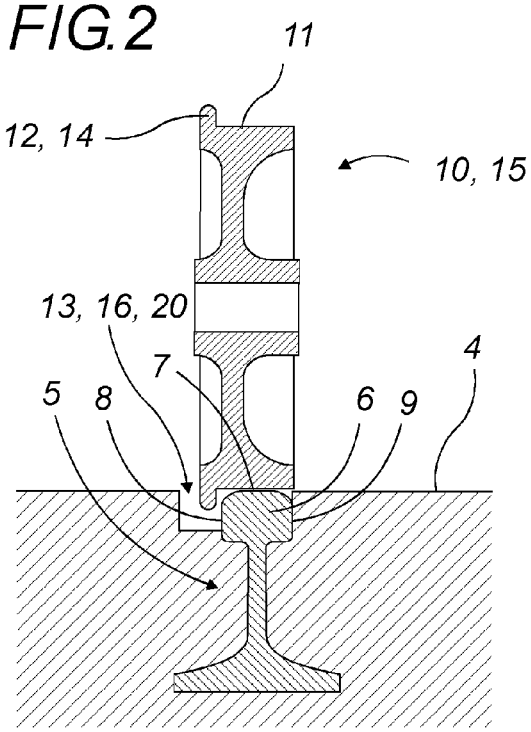
FIG. 2 is a schematic sectional view of a railway wheel running on a conventional railway rail with a lateral passage space in the form of a groove provided between a lateral face of the rail head and the road surface.
Figure 3:
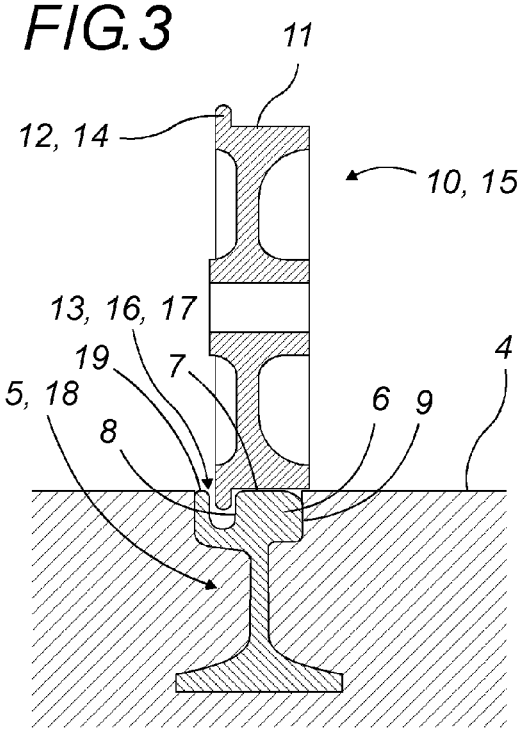
FIG. 3 is a schematic sectional view of a railway wheel running on a conventional railway rail with a lateral passage space in the form of a groove provided on the side of the rail head which groove is edged on the side by a flange.

As can be seen in FIGS. 2 and 3, conventional railway wheels 10 generally have a tread 11 also referred to as the running surface, in contact with the upper face 7 of the rail head 6, and a flange 12 or rim which ensures guidance by bearing on the first lateral face 8 of the rail head 6.

On a standardised profile, the flange 12 is normally 30 mm high and 32 mm wide.

Because the first rail system 2 is embedded into a traffic-bearing road surface 4, there must be a space 13 left in the road surface 4 or in the rail head 6 to allow passage for the flange 12.

In the case of a wheel 5 not designed for the circulation of a conventional railway wheel 10, such a space may also be necessary for the passage of any other type of relief structure 14 in a rolling or guidance means 15.

This space 13 may be necessary on only one side of rail head 6, or on both sides, for instance for the circulation of a railway wheel with two flanges or for any other rolling or guidance means 15 having relief structures 14.

Accordingly, in the first rail system 2, a spacing means is included to establish a passage space 13 on at least the first lateral face 8 of the rail head 6.

This means of spacing 16 may be included in a conventional manner in the form of a groove 17 made in the rail head 6 on the side of the first lateral face 8 of the first rail 5. As in the case of a conventional rail having a groove 18, also known as a "Broca" rail, said groove 17 is sometimes edged by a side flange 19.

The spacing means 16 may also be in any other shape allowing a passage space 13 to be formed on at least one side of the rail head 6. It can also appear as a free volume 20 provided between the first lateral face 8 of the rail head 6 and the road surface 4.

The second rail system 3 is preferentially designed for the guidance of a vehicle. At least one first rail 21 having a rail head 22 whose upper surface 23 is approximately flush with the road surface 4.

The guide rail 21 is preferably, but not exclusively, a guide rail 21 for a tire-mounted tram, for instance, guided by a central rail with inclined rollers bearing the lateral surfaces 24, 25 of the rail head 22 by their bearing surface.

This guide rail 21 crosses the first rail 5 and is interrupted at its point of crossing with the first rail 5 in order to form two portions of rail 26, 27, that is a first portion 26, for instance located on the side of the first lateral face 8 of the first rail 5 and a second portion 27, for instance situated on the side of the second lateral phase 9 of the first rail 5.

These two portions 26, 27 have ends 28, 29 facing each other on each side of the first rail 5 at the crossing, that is a first end 28, for instance located on the side of the first lateral face 8 of the first rail 5 and a second end 29, for instance, located on the side of the second lateral face 9 of the first rail 5.

In order to allow guidance, the two portions 26, 27 must be immediately next to the first rail 5 while the head 6 of the latter preferentially has transversal cut-outs 30 in order to clear a passage for the means of guiding the vehicle guided by the rail; the cut-outs can be transversal 30 and made in a direction parallel to the axis of the two guide rail 21 portions 26, 27. These transversal cut-outs 30 appear very clearly in the FIGS. 4 to 8.

The term "immediately next to" refers to a sufficiently small distance for it not to represent a discontinuity or not too great a distance so as not to affect the reliability and quality of the guidance. It is less than 1 cm and preferably between 1 and 5 mm.

Note that transverse cut-outs 30 are the only modifications that may need to be made to the first rail 5 when the crossing device of the intervention is installed. Accordingly, at the crossing, the first rail 5 does not need to be cut or interrupted and may advantageously be left in one piece.

In the figures, at the crossing, the means of spacing 16 to allow the passage of the flanges 12—or any other type of relief structure 14 by means of a bearing or a guide 15—represents the gradual and partial filling in 31 so that this means of running or guidance 15 stands on a first rail 5, not via the bearing surface of the rail but by its flange 12 or an equivalent relief structure 14. This transfer of the rolling force onto the flanges 12 or equivalent relief structures 14 limited to the level of the crossing is known to the professional under the name of the "flangeway" principle. In particular, it is a way of avoiding that the means of rolling or guidance 15 do not fall into the transversal cut-outs 30, which would generate a great deal of noise and cause considerable wear both of the rail and of the means of rolling or guidance.

It is also noteworthy that the wheels of the vehicle designed to travel over the first rail system rest only on the rails 5 on the first rail system and not on any moving parts of the device. Therefore, the weight of the vehicle designed to travel over the first rail system does not rest on the first or the second portion 26, 27 of the second rail system, nor on the extensible section 32, nor on the manoeuvring means 33 of the flanged of flange 12 or the equivalent relief structure(s) 14 of the railway wheel 10 or of any other means of rolling or guidance 15 on the first rail 5, and at least one of the ends 28, 29 of the two portions 26, 27 must have the capability of being moved away from the first rail 5.

This separation must be sufficient to allow the passage of the flange or flanges 12 or the equivalent relief structure(s) 14 at the means of spacing 16 provided on the first rail 5. This distance is greater than 1 cm and preferably in the region of 3 to 5 cm.

It is noteworthy that the means of rolling or guidance 15, depending on its nature and shape, is not necessarily designed to roll on the first rail 5 but may also slide on it or be temporarily in contact with it for guidance.

In order to be able to move the ends 28, 29 of the two portions 26, 27 away from the first rail 5, device 1 includes at least one extensible part 32 included at least in the first or second portion 26, 27.

Although in the figures or illustrations, the extensible part 32 has always been represented preferentially in the first portion 26, there is nothing to prevent having the extensible part 32 be located in the second portion 27.

When the first rail 5 includes a groove 17, provision is made for an extensible part 32 on the side of the groove.

Naturally, an extensible part 32 may also be provided for in the first portion 26, in the second portion 27, or in both portions 26, 27 of guidance means 15 provided for it to run or slide on this rail 5.

If the first rail system 2 includes a pair of rails 5 and **5*b* and if the extensible part 32 of the second rail system 3 is situated between them (see FIG. 7), the gap between these rails and/or the angle of inclination between the first rail system 2 and the second rail system 3 must however be sufficient for the extension and contraction amplitudes of the extensible part 32** to allow the maximum separation defined in the above.

This extensible part 32 may appear in the form of an extensible part 32 customarily designed to absorb the thermal expansion phenomena of the rails. It may appear in any other form allowing the reduction or extension of the length of guide rail 21.

Figure 15:
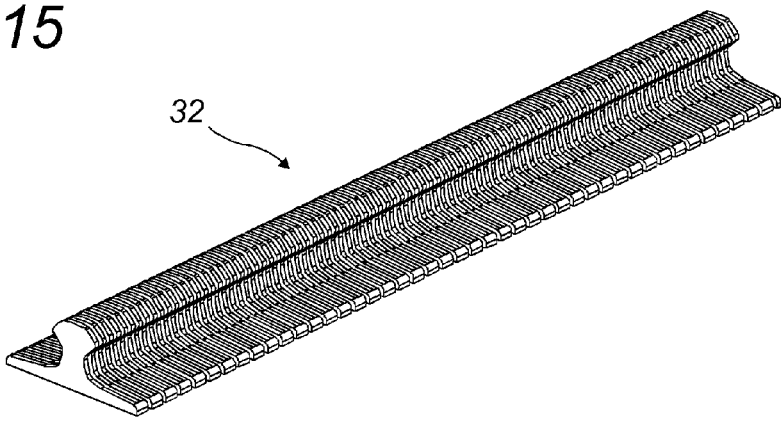
FIGS. 15 and 16 are respectively perspective and profile views of an extensible portion consisting of alternate machining into the guide rail.
Figure 16:
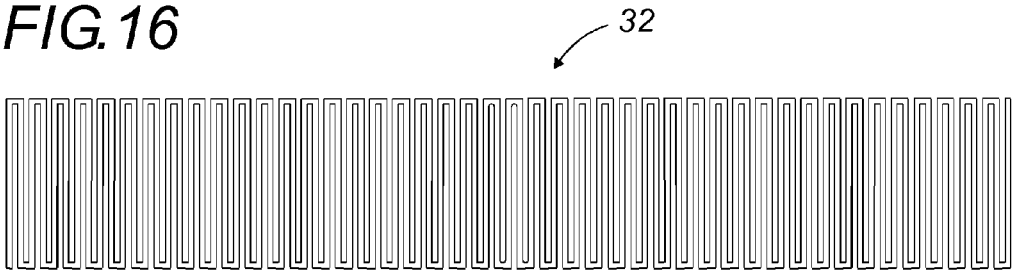

According to a first variant of the extensible part 32 shown in FIGS. 15 and 16, it consists of alternating machining into the guide rail 21.

Figure 17:
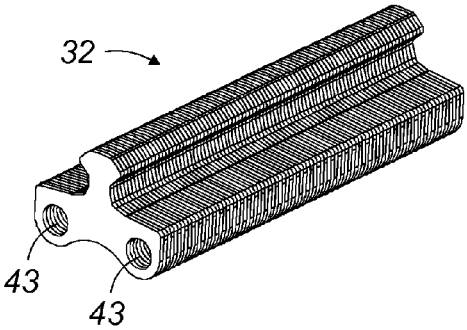
FIGS. 17 and 18 are respectively perspective and profile views of an extensible portion consisting of an assembly of transverse leaves.
Figure 19:
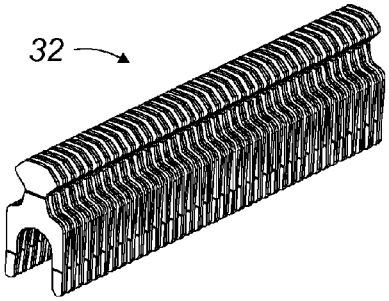
FIGS. 19 and 20 are respectively perspective and profile views of an extensible portion consisting of a stack of flexible leaves, welded alternately at the top and bottom in an accordion-like manner.
Figure 18:
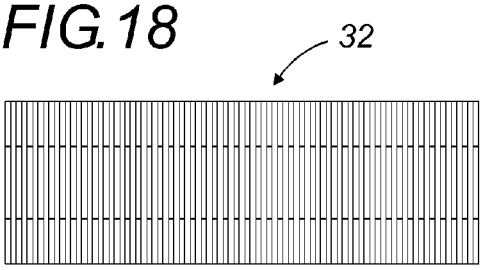
Figure 20:
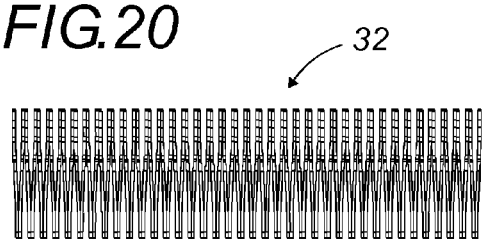

According to a second variant shown in FIGS. 17 and 18, the extensible part 32 consists of an assembly of transversal leaves.

These transversal leaves may be connected together by telescoping nesting or by sliding on at least one shared longitudinal guiding structure.

Accordingly, in FIGS. 17 and 18, the transversal leaves have holes 43 drilled into the lower section allowing the insertion of two guide bars (not shown) common to all the transversal leaves, to maintain them and guide them during contraction and extension according to these guide bars.

According to a third variant shown in FIG. 18, the extensible part 32 comprises a stack of flexible leaves, alternately welded at the top and the bottom in an accordion-like manner. Because the device is embedded into the road surface, there is room available towards the bottom for it so that, according to this fourth variant, the flexible leaves can be relatively high and extend downwards to provide greater amplitude for the extension and contraction of extensible part 32.

An elastic material can be interposed between each transversal leaf to ensure better continuity of the extensible part 32 of the rail between the transversal leaves. This elastic material, in particular, avoids the soiling of any gaps between the leaves by various urban dirt and waste, and also the possibility of a pedestrian being caught between two leaves during the contraction of the extensible part 32, guaranteeing in this way a supplementary degree of safety for the device. The extensible part 32 is preferentially in the form of a rubber/metal sandwich.

The device 1 also includes a manoeuvring means 33 designed to extend and contract the length of the extensible part 32 of guide rail 21. This manoeuvring means 33 is used for forcing the extensible part 32 to extend or to contract, according to an amplitude far greater than encountered in the case of simple thermal expansion caused by temperature variations.

This manoeuvring means 33 is a way of moving at least one of the ends 28, 29 of the two portions 26, 27 between a contracted position in which for instance, the first end 28 is placed at a distance from the first rail 5, this distance being sufficient to allow the circulation of a vehicle or any other movable device on the trail 5 and an extended position, for instance, in which the first end 28 is located closer to the first rail 5 with immediate proximity being sufficient to ensure the guidance of a vehicle on guide rail 21.

Figure 8:
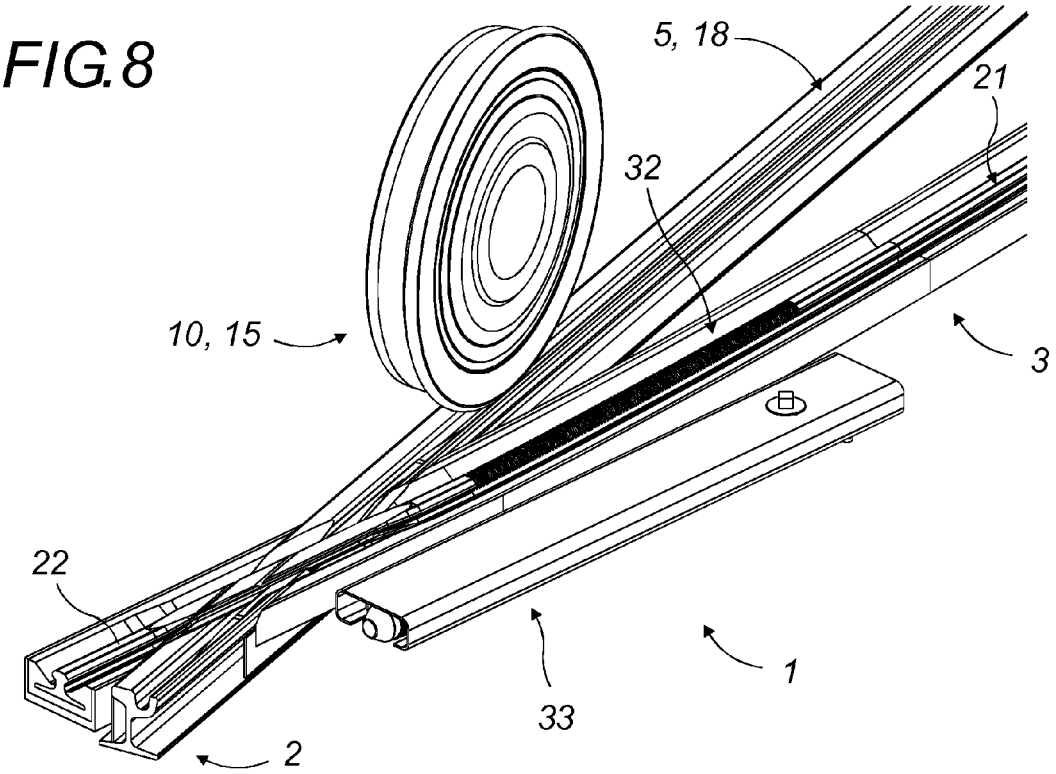
FIG. 8 is a general perspective view from above the rail crossing device of an embodiment in an alternative with the movement of the extensible part on one side only and in which the manoeuvring means is located on the side of the extensible part and includes a control worm screw.
Figure 9:
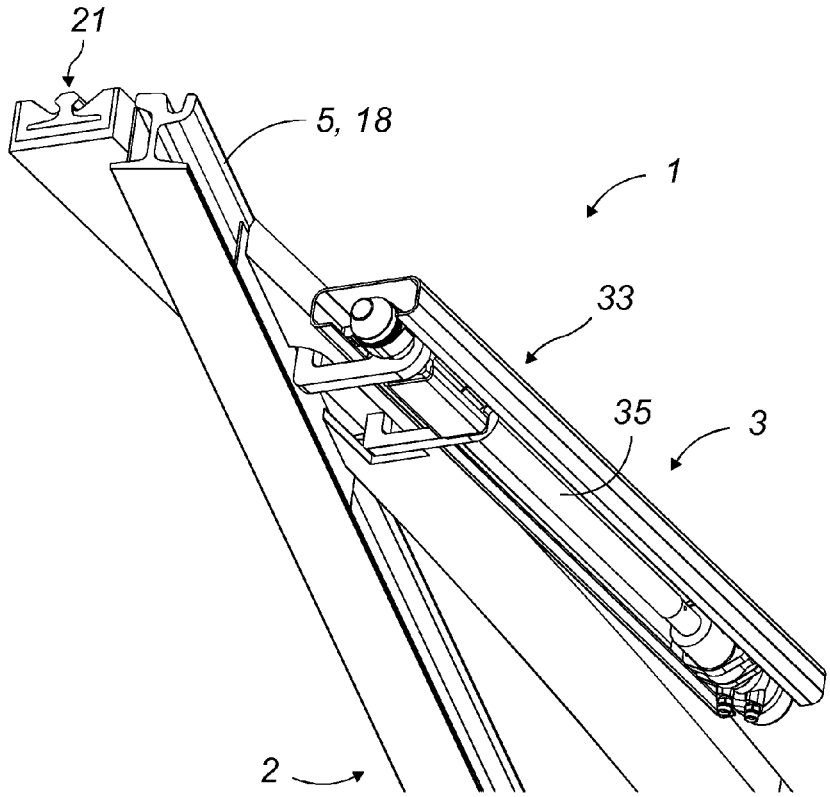
FIG. 9 is bottom view corresponding to FIG. 8.
Figure 10:
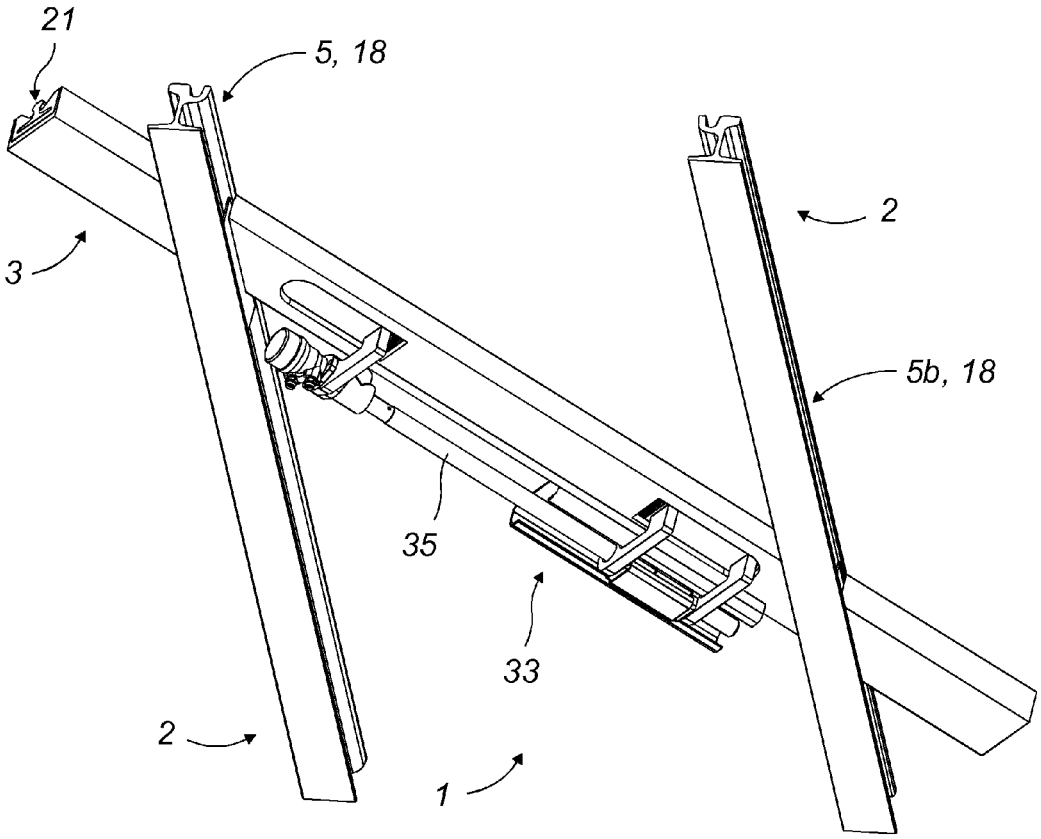
FIG. 10 is a general perspective view from beneath the rail crossing device of an embodiment in an alternative with the movement of the extensible part on both sides and in which the manoeuvring means is situated on the side of the extensible part and includes a control worm screw.
Figure 11:
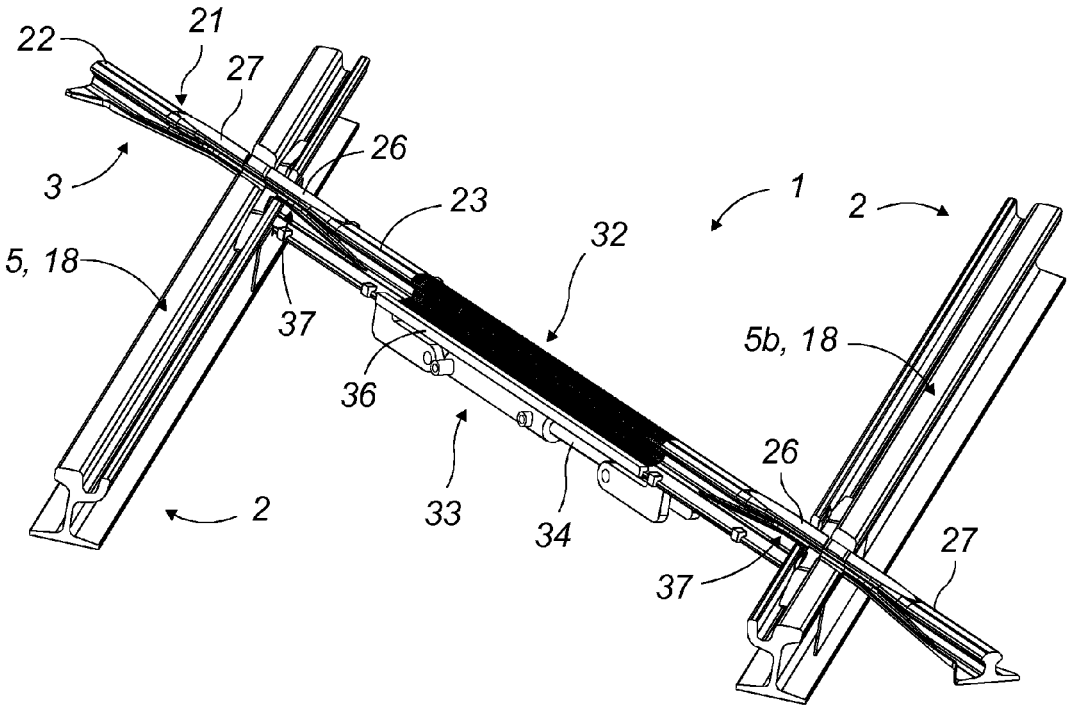
FIG. 11 is a general perspective view from above the rail crossing device of an embodiment in an alternative with the movement of the extensible part on the two sides and in which the manoeuvring means is situated under the extensible part and includes a hydraulic, pneumatic or electric actuator.
Figure 12:
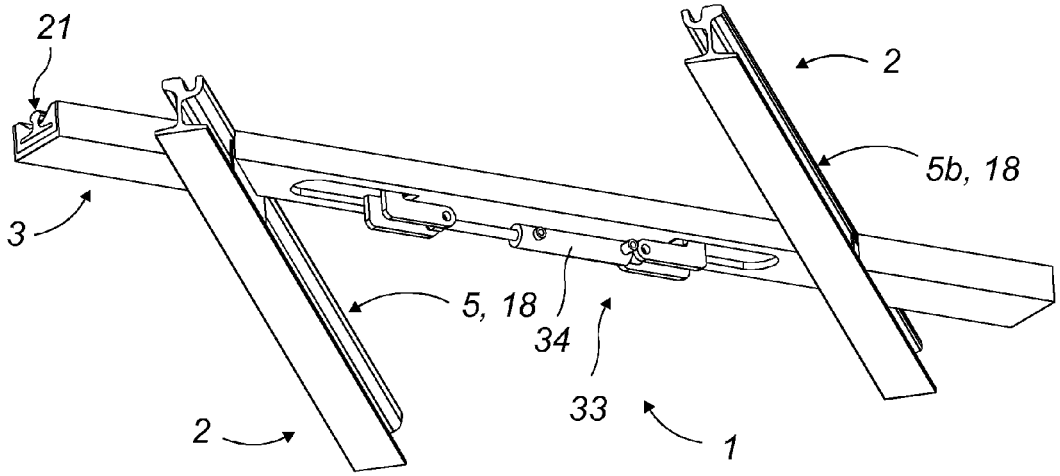
FIG. 12 is a general perspective view from beneath the rail crossing device of an embodiment in an alternative with the movement of the extensible part on the two sides and in which the manoeuvring means is situated under the extensible part and includes a hydraulic, pneumatic or electric actuator.

According to a presently described embodiment shown in FIGS. 11 and 12, the manoeuvring means 33 includes at least one hydraulic, pneumatic 34 or electric actuator According to another presently described embodiment shown in FIGS. 8 to 10, the manoeuvring means 33 includes at least one worm screw 35.

The manoeuvring means 33 preferentially includes at least one manual emergency manoeuvring device designed to allow the manual operation of manoeuvring means 33 in the event of failure, in particular of the control system.

If the manoeuvring means 33 includes at least one worm screw 35, this manual emergency manoeuvring device may include a crank handle and an angle drive in order to operate the worm screw or screws 35.

Advantageously, the manoeuvring means 33 is an irreversible system meaning that it remains fixed in position even in the event of its power supply being cut off so that it is naturally locked in the extended or contracted position of the extensible part 32 to ensure optimal safety.

The extensible safety position of the manoeuvring means 33 corresponds preferably to that of the contraction of the extensible part 32 because this position allows a vehicle to pass over the first rail system 2 and also offers optimal chances of the vehicle passing on to the second rail system 3, especially if it is in a straight line.

In order not to bring to much solicitation to bear on the extensible part 32 of the first portion 26, the rail crossing device 1 is preferentially built in the free state to assume a balanced position at the mid-travel point. Accordingly, the contracted position for the extensible part 32 of the guide rail 21 corresponds to a balanced position at mid travel of the manoeuvring means 33.

Device 1 also includes preferentially a means of guiding the path 36 for the extensible part 32 of the guide rail 21 in order to guide the lengthwise extension and contraction of extensible part 32 along a defined path.

Without this system of guidance, the lengthwise extension and contraction of extensible part 32 could take place along an undesirable path, which would not allow, for instance at one of the ends 28, 29 of portions 26, 27, to come immediately next to the first rail 5 during the extension of extensible part 32 of first portion 26.

Although the figures only depict the straight and level rails for the first and second system of rails 2, 3, the presently described embodiments of the device are perfectly suited to work with curved rails. If the extensible part 32 is curved for the second rail system 3, the path guiding means 36 also ensures that the lengthwise extension and contraction of extensible part 32 take place on the general curved path of the rail, for instance the arc of a circle.

During the lengthwise extension of the extensible part 32, it is important that the first end 28 of the guide rail 21 is able to move up close to the first rail 5. The spacing means 16 of this rail, or any other element located at the bottom of the first rail, for instance, impedes this movement.

Accordingly, the first end 28 of guide rails 21 preferentially includes a hollow 37 on the upper face 23 of the rail head 22 in order to be able to slide over the means of spacing 16 of the first rail 5 during the lengthwise extension of the extensible part 32 of the first section 26.

When the spacing means 16 is gradually and partially filled in 31, the hollow 37 under the upper face 23 of the rail head 22 must be big enough to allow the first end 28 of the guide rail 21 to be able to slide over the gradual and partial filling 31 during the extension of the extensible part 32.

Similarly, when the spacing means 16 consists of a groove 17 edged by a flange 19, it will preferentially include a cut-out 38 so that the first end 28 of guide rail 21 is able to slide over the spacing means 16 of the first rail 5 during the lengthwise extension of the extensible part 32 of the first portion 26.

Figure 4:
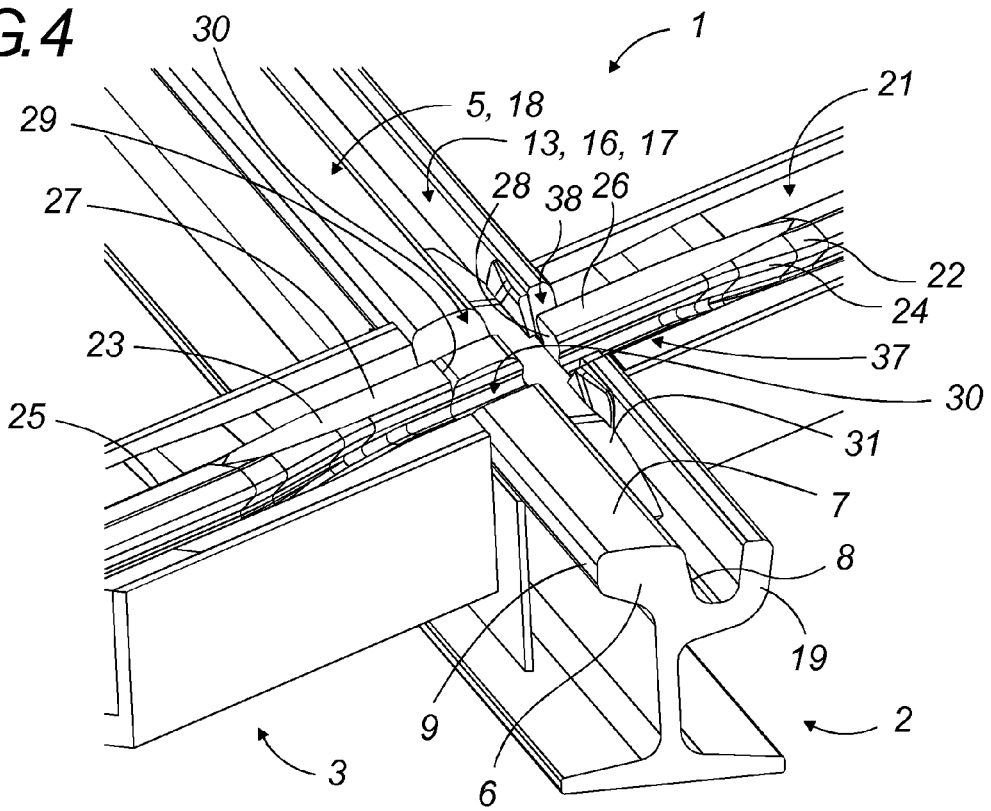
FIG. 4 is a detailed view of the rail crossing device of an embodiment at the point of crossing between a conventional railway rail and a guide rail in which the first end of the guide rail is moving away from the conventional railway rail.
Figure 5:
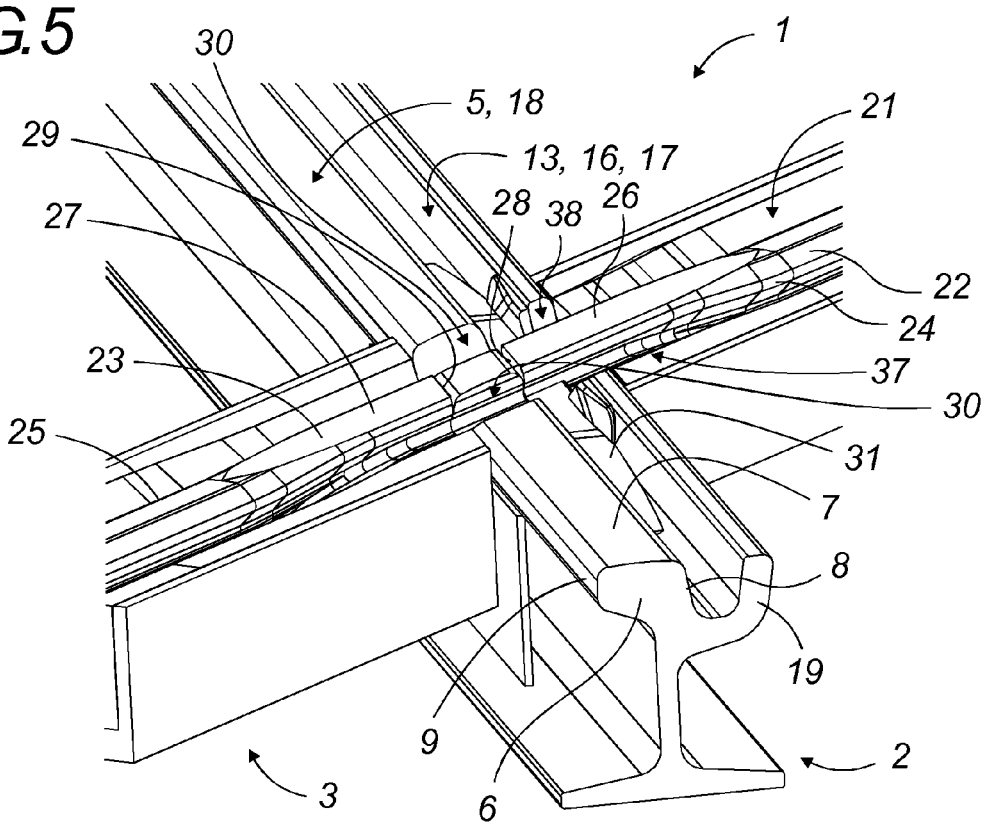
FIG. 5 is a detailed view corresponding to that of FIG. 4, but in which the first end of the guide rail is moving closer, immediately next to the conventional railway rail.

According to presently described embodiments, which can be seen in particular in FIGS. 4 and 5, the principle of the flangeway can also be used for the guide rail 21 at the crossing, in particular to raise the guiding means of the vehicle designed to bear on this rail.

The means of adapting the flangeway principle through the guide rail 21 of the presently described embodiments obviously depends on the type and shape of the guide means for a vehicle, designed to be supported on the guide rail 21.

In the illustrations depicting an example of a guide rail 21, designed for a means of guidance including inclined rollers 39 with flanges 40, these inclined rollers 39 are designed to run via their bearing surface 41 on the lateral faces 24, 25 of rail head 22 of guide rail 21.

According to the aforementioned variant, at the crossing, guide rail 21 includes, for instance, lateral ramps 42 located under the rail head 22, designed to engage flanges 40 of inclined rollers 39 of the guide means of the rail-guided vehicle. These lateral ramps 42 rise towards the first rail 5 which they cross so that, at this rail 5, inclined rollers 39 no longer bear on guide rail 21 by their bearing surface 41 on lateral surfaces 24, 25 of railhead 22 but by the flanges 40 on lateral ramps 42. When these flanges bear on the uppermost part of the lateral ramps 42, the rail-guided vehicle guiding means are raised to facilitate their passage across the first rail 5, in particular above the gradual and partial filling 3 which it may possibly contain.

Figure 13:
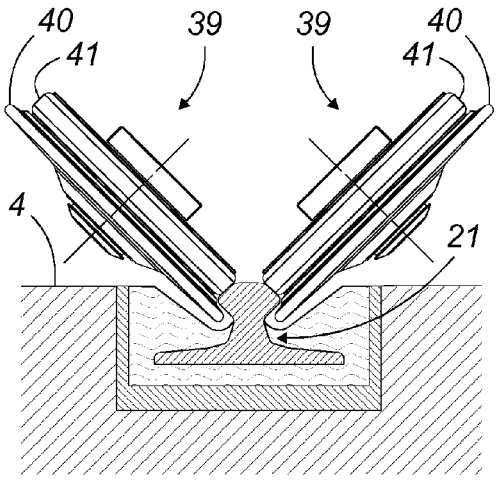
FIG. 13 is a sectional view of the rail crossing device of an embodiment at the guide rail.
Figure 14:
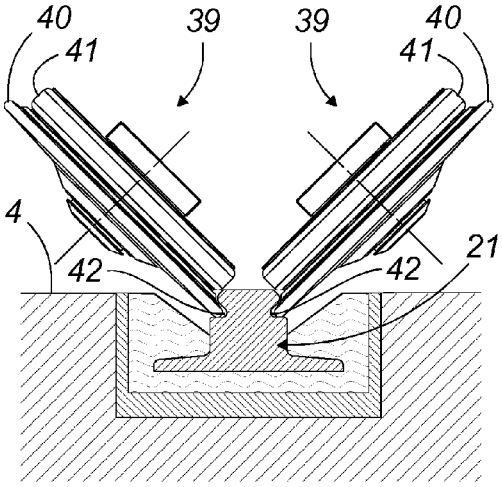
FIG. 14 is a sectional view of the rail crossing device of an embodiment at the guide rail in an alternative using the principle of a bearing groove for the guide rail.

An example of the principle of application of the guide rail flangeway is given as an illustration in FIGS. 13 and 14. The variant shown in the figures is therefore a simple illustration and depends naturally on the guide system being used. It must not be interpreted in a limitative way.

Although it is not shown in the figures, the crossing device 1 preferentially includes a control system for operating the manoeuvring means 33 to cause the lengthwise extension or contraction of the extensible part 32 of guide rail 21 depending on whether a vehicle appears on one rail or the other, 5, 21 of the crossing.

Figure 6:
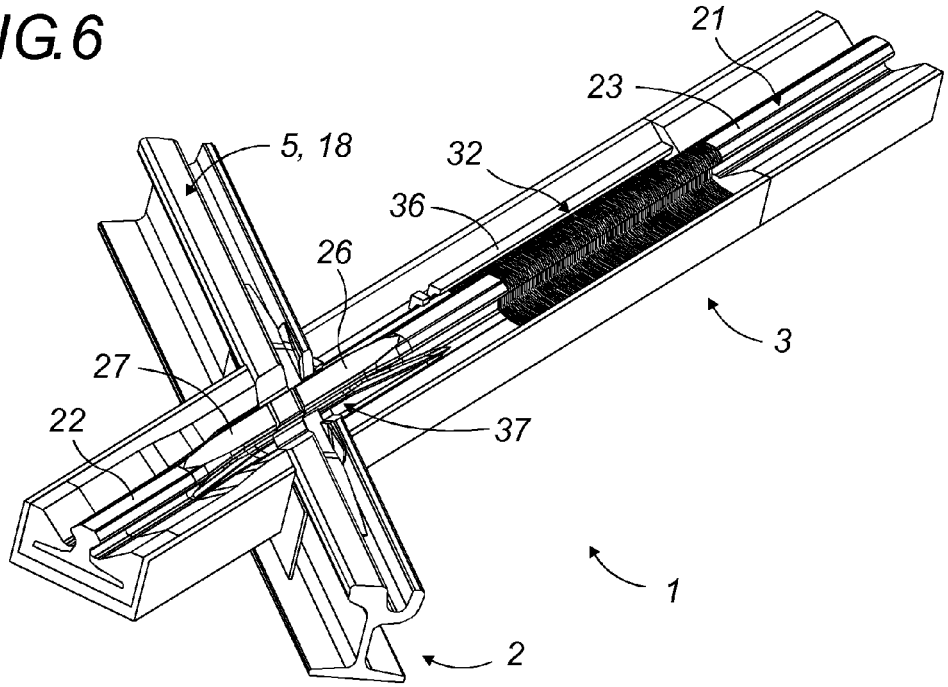
FIG. 6 is a general perspective view from the top of the rail crossing device of an embodiment designed for the crossing between a guide rail and a conventional railway guide according to an alternative with the movement of the extensible part on one side only.

The simplest case of a crossing is that of a crossing between the first rail 5 and a guide rail 21, as shown in FIG. 6.

In this case, the movement of the extensible part 32 can be on one side, that is, the side located nearest to the first rail 5.

Figure 7:
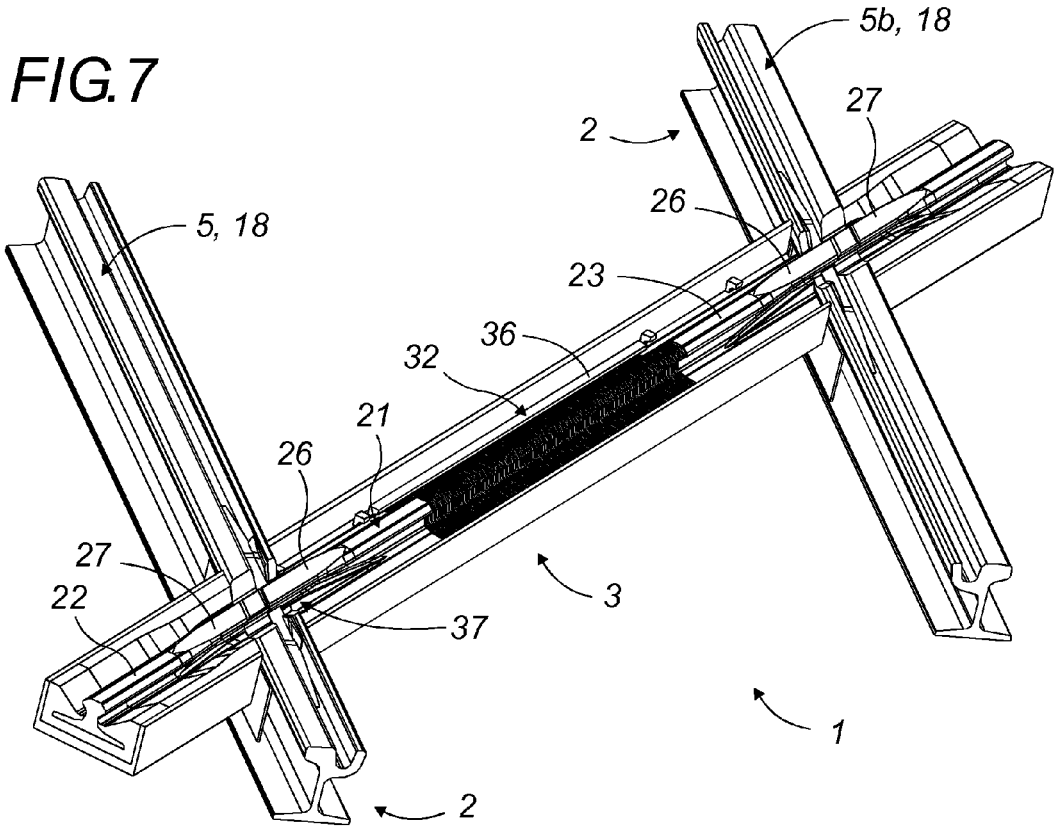
FIG. 7 is a general perspective view from the top of the rail crossing device of an embodiment designed so that the crossing between a guide rail and two parallel railway rails is according to an alternative with movements of the extensible part on both sides.

When the first rail 5 is a railway rail designed for the circulation of a vehicle, it is often installed in pairs with a second rail 5*b*, as shown in FIG. 7. Accordingly, the first rail system 2 includes in this case, a first rail 5 and a second rail 5*b*, and guide rail 21 liable to cross both first rail 5 and second rail 5*b*.

In this case, we can consider using two crossing devices 1, that is a device 1 for the crossing between the first rail 5 and guide rail 21 and another crossing device for the crossing between the second rail 5*b* and guide rail 21, with both devices being operable by a manoeuvring means 33 in common.

It is also possible to envisage the use of a single crossing device 1 according to the presently described embodiments, installed between the first rail 5 and the second rail 5*b*, accordingly with a single manoeuvring means 33 and a single extensible part. In this case, the extension and contraction movement of extensible part 32 takes place on both sides, that is, the side towards the first rail 5 and the side towards the second rail 5*b*, generally with twice the amplitude compared to that needed for crossing a single rail 5.

Crossing device 1 according to the presently described embodiments can also be adapted to other situations without any departure from the spirit of the present description.

Accordingly, the case most frequently encountered is a first rail 5 designed for a means of running or guidance 15 having a relief structure 14 on a single side, generally the inside when there is a pair of conventional railway rails designed for a railway wheel 10 with a relief structure 14 of the flanged type 12, device 1 according to the presently described embodiments can be adapted for a first rail 5 designed for a means of running or guidance 15 having a relief structure 14 on the other side or on both sides.

In this case, the second end 29 of portions 26, 27, situated on the side of the second lateral face 9 of first wheel 5 and in the extension of the first end 28, is not located immediately next to the second lateral face 9 of the first rail 5. Indeed, in this particular case, the second end 29 must be suitable for being moved in the same way as the first end 28, that is, between a distant position and an approached position.

To deal with this technical issue, two crossing devices 1 according to the presently described embodiments need to be used by way of one crossing device on either side of the first rail 5 with an extensible part 32 included in guide rail 21 on either side of first rail 5. Because, in this case, since the two crossing devices 1 used concern the same crossing and the same rails 5, 21 it is nevertheless possible to save on the duplicating of some of the means of the presently described embodiments. Accordingly, for instance, it may be possible to use a single manoeuvring means 33 shared by the two devices 1 in order to extend and contract lengthwise the extensible part 32 of each of them.

It is obvious that the presently described embodiments are not confined to the preferential embodiments described previously and shown in the various figures since the professional can make many modifications to it, and imagine other alternatives, without moving out of the scope of the framework of the presently described embodiments as defined by the claims.

The invention claimed is:

1. A rail crossing device designed for the crossing of a first rail system embedded into a road surface with a second rail system embedded into the road surface, which device including:

a first rail system designed for the movement or guidance of a vehicle or any other moveable device, and including:

at least one first rail having a rail head whose upper surface is approximately flush with the road surface, a first lateral face and a second lateral face opposite the first lateral face; and at least one spacing feature designed to establish a passage space for the relief structures of a guide at the least on one side of the first lateral face of the rail head;

a second rail system for the guidance of a vehicle and including at least one guide rail, which guide rail:

has a rail head with an upper face approximately flush with the road surface and crossing the first rail;

is interrupted at the crossing with the first rail to form two portions, having respectively a first end and a second end extending the first end;

at least one extensible part integrated into at least the first or the second portion;

at least one mechanism designed for lengthwise extension and contraction of the extensible part, defining a contracted position in which the first end is moved away from first rail to allow the passage of a vehicle or any other movable device over the first rail; and an extended position in which the first end is moved closer to first rail to guide a vehicle along the guide rail.

2. The rail crossing device according to claim 1, wherein:

the first portion is located on the side of the first lateral face of the first rail and has a first end located on the side of the first lateral face of the first rail, the second portion is located on the side of the second lateral face of the first rail and has a second end located immediately next to the second lateral face of the first rail and forming an extension to the first end, when the extensible part is in the contracted position, the first end is moved away from the first lateral face of the first rail; and when the extensible part is in the extended position, the first end is moved closer to the first lateral face of the first rail.

3. The rail crossing device according to claim 1, further comprising a path guiding means for the extensible part of the guide rail in order to guide it in the lengthwise extension and contraction of extensible part on a defined path.

4. The rail crossing device according to claim 1, wherein the spacing feature is in the form of a groove made in the rail head on the side of the first lateral face of the first rail.

5. The rail crossing device according to claim 4, wherein the groove is edged laterally by a flange, and in that at the crossing of this flange there is a cut-out which allows the first end of the guide rail to slide over the spacing feature of the first rail during the extension of the extensible part.

6. The rail crossing device according to claim 1, wherein the spacing feature consists of a free volume provided between the first lateral face of the rail head and the road surface.

7. The rail crossing device according to claim 1, wherein the extensible part of guide rail consists of alternating machining into the rail.

8. The rail crossing device according to claim 1, wherein the extensible part of guide rail consists of an assembly of transversal leaves.

9. The rail crossing device according to claim 8, wherein an elastic material is interposed between each transversal leaf.

10. The rail crossing device according to claim 1, wherein the extensible part of guide rail consists of an assembly of transversal leaves connected together by telescopic nesting or by sliding over at least one shared longitudinal guide structure.

11. The rail crossing device according to claim 1, wherein the extensible part of guide rail consists of a stack of flexible leaves welded in alternation at the top and bottom like an accordion.

12. The rail crossing device according to claim 1, wherein, for the extensible part, the contracted position corresponds to a balanced position at the mid-travel point with respect to the mechanism designed for lengthwise extension and contraction of the extensible part.

13. The rail crossing device according to claim 1, wherein, at the crossing, the first rail has cut-outs in its rail head to clear a passage for the guide of the rail-guided vehicle.

14. The rail crossing device according to claim 13, wherein the cut-outs are transversal and made in parallel to the axis of the two portions of the guide rail.

15. The rail crossing device according to claim 1, wherein the first rail is continuous and in one piece.

16. The rail crossing device according to claim 1, wherein, at the crossing, the first end of guide rail has a hollow under the upper face of the rail head enabling it to slide over the spacing feature of the first rail when the extensible portion is extended.

17. The rail crossing device according to claim 1, wherein the mechanism designed for lengthwise extension and contraction of the extensible part includes at least one hydraulic, pneumatic or electric actuator.

18. The rail crossing device according to claim 1, wherein the mechanism designed for lengthwise extension and contraction of the extensible part includes at least one worm screw.

19. The rail crossing device according to claim 1, further comprising at least one manual emergency manoeuvring device for operating the mechanism designed for lengthwise extension and contraction of the extensible part by hand in case of failure.

20. The rail crossing device according to claim 1, wherein the vehicle or another movable device designed to travel over the first rail system has wheels designed to run on at least one first rail and in that these wheels bearing solely on this first rail.

* * * * *